US007119633B2

(12) United States Patent
Stoneham

(10) Patent No.: US 7,119,633 B2
(45) Date of Patent: Oct. 10, 2006

(54) COMPENSATED INTERDIGITATED COUPLER

(75) Inventor: Edward B. Stoneham, Los Altos, CA (US)

(73) Assignee: Endwave Corporation, Sunnyvale, CA (US)

( * ) Notice: Subject to any disclaimer, the term of this patent is extended or adjusted under 35 U.S.C. 154(b) by 9 days.

(21) Appl. No.: 10/925,684

(22) Filed: Aug. 24, 2004

(65) Prior Publication Data

US 2006/0044073 A1 Mar. 2, 2006

(51) Int. Cl.
*H01P 5/18* (2006.01)

(52) U.S. Cl. ..... 333/116; 333/246

(58) Field of Classification Search ..... 333/109, 333/111, 115, 116, 118
See application file for complete search history.

(56) References Cited

U.S. PATENT DOCUMENTS

| | | | | |
|---|---|---|---|---|
| 3,319,190 | A | 5/1967 | Shively | 333/115 |
| 3,371,284 | A | 2/1968 | Engelbrecht | 330/286 |
| 3,516,024 | A | 6/1970 | Lange | 333/116 |
| 3,534,299 | A | 10/1970 | Eberhardt | 333/24.2 |
| 3,678,433 | A | 7/1972 | Hallford | 333/203 |
| 4,127,831 | A | 11/1978 | Riblet | |
| 4,394,630 | A | 7/1983 | Kenyon et al. | 333/116 |
| 4,777,458 | A | 10/1988 | Pardini | 333/112 |
| 4,800,345 | A | 1/1989 | Podell et al. | 333/111 |
| 4,937,541 | A | 6/1990 | Podell et al. | 333/116 |
| 5,075,646 | A | 12/1991 | Morse | 333/116 |
| 5,111,165 | A | 5/1992 | Oldfield | |
| 5,132,645 | A | 7/1992 | Mayer | |
| 5,243,305 | A * | 9/1993 | O'Oro et al. | 333/116 |
| 5,745,017 | A * | 4/1998 | Ralph | 333/116 |
| 6,147,570 | A * | 11/2000 | Gill | 333/116 |
| 6,794,954 | B1 | 9/2004 | Gurvich et al. | 333/116 |
| 6,822,532 | B1 | 11/2004 | Kane et al. | 333/116 |
| 6,825,738 | B1 | 11/2004 | Shumovich | |

* cited by examiner

*Primary Examiner*—Dean Takaoka
(74) *Attorney, Agent, or Firm*—Kolisch Hartwell, PC

(57) ABSTRACT

A coupler may include four ports, and first and second sets of conductive strips. Each set of conductive strips may include a plurality of interconnected conductive strips connected between two ports. Each conductive strip of the first set may be electromagnetically coupled to a conductive strip of the second set. Conductive tabs capacitively coupled directly or indirectly to the ground conductor may extend from conductive strips of the first and second sets. An interconnection may be positioned between adjacent tabs, the interconnection connecting conductive strips of one of the sets of conductive strips. The adjacent tabs may be spaced different distances from the interconnection.

19 Claims, 2 Drawing Sheets

COMPENSATED INTERDIGITATED COUPLER

BACKGROUND

A pair of conductive lines are coupled when they are spaced apart, but spaced closely enough together for energy flowing in one to be induced in the other. The amount of energy flowing between the lines is related to the dielectric medium the conductors are in and the spacing between the lines.

Couplers are electromagnetic devices formed to take advantage of coupled lines, and may have four ports, one for each end of two coupled lines. A main line has an input end connected directly or indirectly to an input port. The other end is connected to the direct port. The other or auxiliary line extends between a coupled port and an isolated port. A coupler may be reversed, in which case the isolated port may become the input port and the input port may become the isolated port. Similarly, the coupled port and direct port may have reversed designations. Couplers may be used as power combiners or splitters (dividers).

Directional couplers are four-port networks that may be simultaneously impedance matched at all ports. Power may flow from one or the other input port to the pair of output ports, and if the output ports are properly terminated, the ports of the input pair are isolated.

The Lange coupler is a four-port, interdigitated structure developed by Dr. Julius Lange around 1969. The length of the interdigitated fingers may be about one-quarter of the wavelength of a design frequency.

BRIEF SUMMARY OF THE DISCLOSURE

A coupler may include four ports, and first and second sets of conductive strips. Each set of conductive strips may include a plurality of interconnected conductive strips extending between two ports. Each conductive strip of the first set may be electromagnetically coupled to a conductive strip of the second set. Conductive tabs capacitively coupled directly or indirectly to a ground conductor may extend from conductive strips of the first and second sets or from the ports. An interconnection may be positioned between adjacent tabs, the interconnection connecting conductive strips of one of the sets of conductive strips. The adjacent tabs may be spaced different distances from the interconnection.

BRIEF DESCRIPTION OF THE SEVERAL FIGURES

DETAILED DESCRIPTION OF VARIOUS EMBODIMENTS

Figure 1:
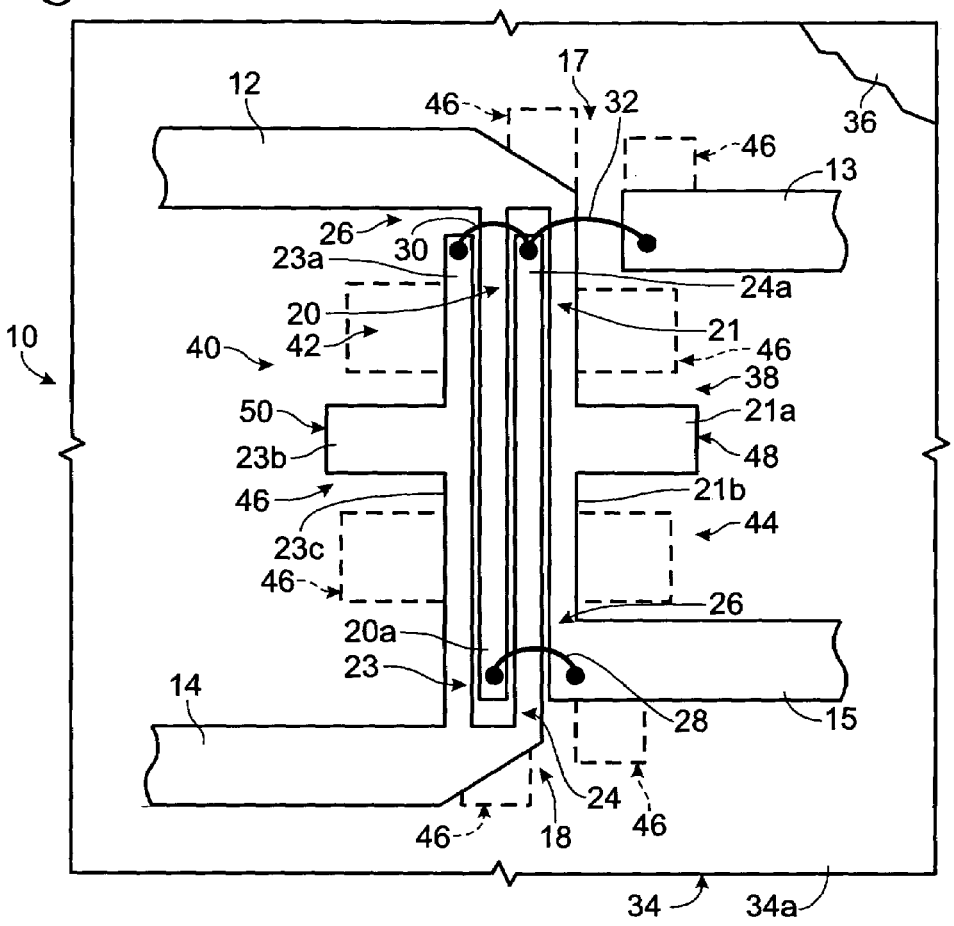
FIG. 1 is a plan view of a first coupler design.

FIG. 1 illustrates a plan view of a coupler 10. Coupler 10 may have a configuration commonly referred to as a Lange coupler. For example, coupler 10 may include ports 12, 13, 14 and 15. Ports 12–15 may variously be referred to as input, coupled, isolated, and direct ports. More than four ports may be used. In some examples, one or more ports may be terminated by an impedance, in which case the point of connection to the impedance is considered to be a port. The ports may be variously interconnected and coupled together by a plurality of sets of interdigitated conductive strips or fingers, such as sets 17 and 18. Each set of fingers may include a plurality of fingers. In this example, set 17 includes fingers 20 and 21, and set 18 includes fingers 23 and 24. The fingers are shown in a coplanar configuration, although they may also be arranged in a three-dimensional array and may include more than two sets of fingers.

It is seen that set 17 interconnects ports 12 and 15, and set 18 interconnects ports 13 and 14. In particular, fingers 20 and 21 extend integrally from port 12, with finger 21 also integrally connected to port 15. An interconnection 26, in the form of a bridge or wire bond 28 interconnects a distal end 20*a* of finger 20 with port 15. Fingers 23 and 24 extend integrally from port 14. A further interconnection 26 interconnects fingers 23 and 24 with port 13. In particular, a bridge 30 interconnects distal ends 23*a* and 24*a* of fingers 23 and 24. A further bridge 32 interconnects distal end 24*a* with port 13, as shown. Other forms of interconnections may also be used, such as wire ribbons, chip-mounted conductors, or conductors extending through an insulating or dielectric substrate 34 on which the ports and fingers are mounted. The ports and fingers are shown in coplanar configuration mounted on a primary face 34*a* of the substrate. Although other configurations may be used, a signal-return or ground plane 36 may be mounted on the backside or opposite primary face of the substrate.

Set 17 of fingers in combination with spaced ground plane 36 form what may be considered a first microstrip transmission line 38, and set 18 and the ground plane form a second microstrip transmission line 40. Signals may propagate through the coupler in even and odd modes of propagation. The even-mode of propagation corresponds to propagation when the transmission lines of the coupler are driven in-phase at one end of the coupler, and the two transmission lines behave like a single microstrip transmission line 42. The odd-mode of propagation corresponds to propagation when the transmission lines of the coupler are driven 180 degrees out of phase, and the transmission lines behave like a parallel-wire transmission line 44. The interdigitated fingers provide strong coupling.

In an uncompensated Lange coupler including only the interdigitated fingers, the even-mode propagation velocity of a signal through the coupler may be faster than the odd-mode propagation velocity. The directivity of the coupler may be high when the even-mode propagation velocity equals the odd-mode propagation velocity. The even-mode velocity may be decreased relative to the odd-mode velocity by increasing the capacitance per unit length and inductance per unit length of the microstrip line 42 relative to the parallel-wire transmission line 44. The impedance of microstrip line 42 may be maintained by maintaining the balance between capacitance and inductance. Conductive tabs 46 may be placed at one or more positions along a finger of the coupler, and may provide an increase in capacitance per unit length. When a tab 46 of one of transmission lines 38 and 40 extends along ground plane 36 and couples directly or indirectly to the ground plane more than to the other transmission line, the even-mode propagation velocity may be decreased relative to the odd-mode propagation velocity.

In the example shown in FIG. 1, fingers 21 and 23 have extensions 21*a* and 23*b* extending from intermediate portions of respective outer sides 21*b* and 23*c* facing away from the other fingers. Fingers 20 and 24 are adjacent to other fingers on both sides and do not have any extensions in this example. Extensions 21*a* and 23*b* form respective capacitive tabs 48 and 50. These tabs may increase the capacitance to ground for the transmission line of which each is a part. A decrease in the width and spacing of the portions of the fingers not connected to the tabs, may provide a corresponding increase in the inductance per unit length of the fingers, thereby maintaining the even-mode impedance of the transmission lines. Tabs may be provided for each of transmission lines 38 and 40 to provide equivalent compensation. Other forms of capacitive tabs may also be used. For example, a ground layer may be formed on the upper substrate face, with the tab extending over all or a portion of that ground layer and separated from it by a dielectric layer. The tabs then form part of a metal-insulator-metal (MIM) capacitor. Also, optionally, the tabs may be connected to the fingers by interconnections, such as wire or ribbon bonds.

Additionally or alternatively, tabs 46 may be positioned at other locations on coupler 10. For example, there may be a plurality of tabs distributed along fingers 21 and 23, as shown in dashed lines. Further, there may be one or more tabs 46 positioned at the ends of the fingers, such as a tab on each of ports 12, 13, 14 and 15, as is also shown in dashed lines. Tabs on different conductors may be spaced far enough apart so that they do not significantly couple to each other, but rather primarily couple to ground plane 36.

Figure 3:
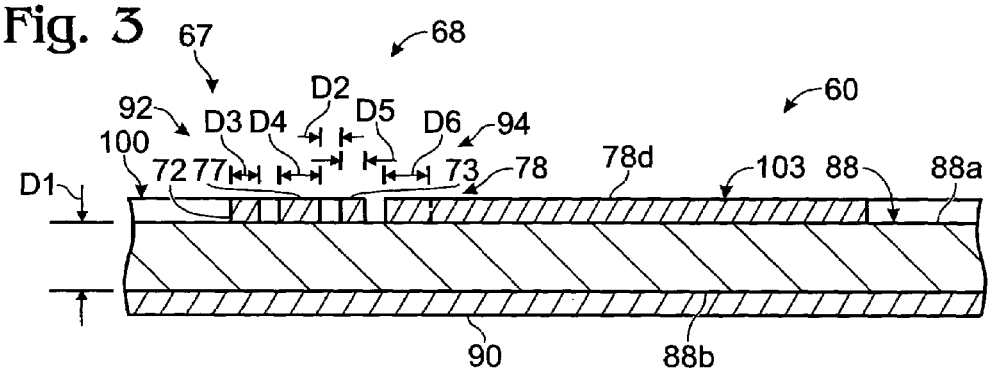
FIG. 3 is a cross section taken along line 3—3 in FIG. 2.
Figure 2:
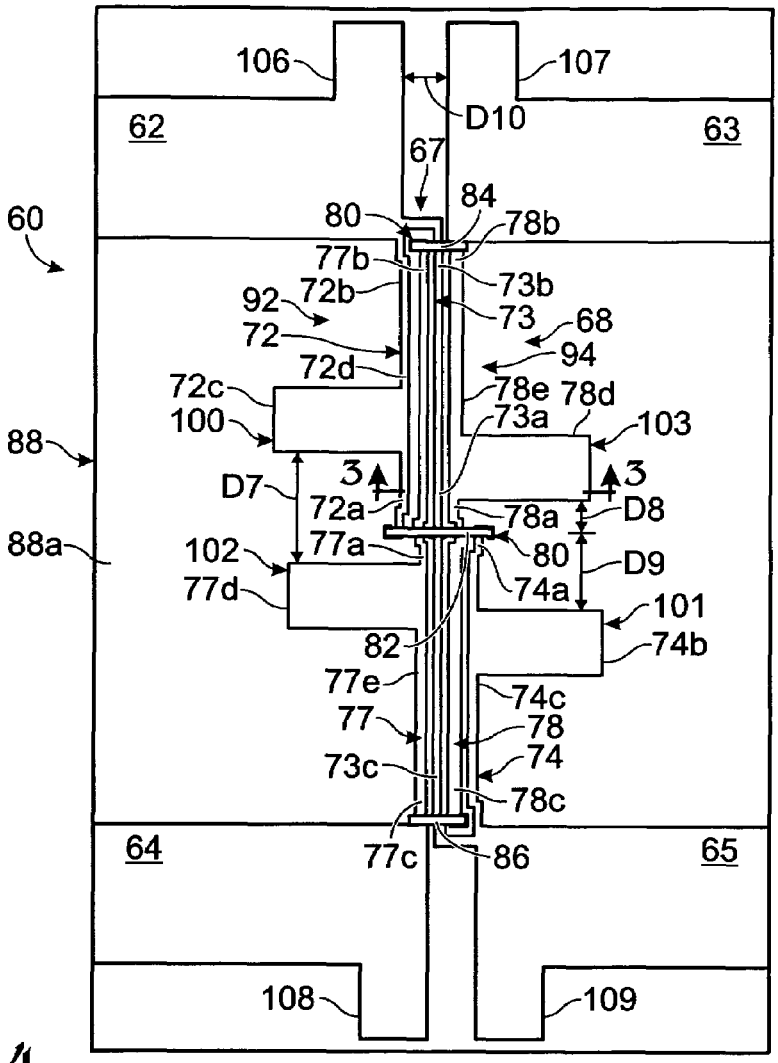
FIG. 2 is a plan view of a second coupler design.

FIGS. 2 and 3 depict a second coupler 60. Coupler 60 is similar to coupler 10 and includes four ports 62, 63, 64 and 65. The ports are interconnected by sets 67 and 68 of conductive strips. In particular, set 67 interconnects ports 62 and 65, and includes conductive strips or fingers 72, 73 and 74, and set 68 interconnects ports 63 and 64, and includes fingers 77 and 78. Fingers 72 and 74 are about half the length of the other fingers. Fingers 72 and 73 are integrally joined to port 62, and fingers 73 and 74 are integrally joined to port 65. Fingers 72 and 74 have respective distal ends 72*a* and 74*a* that end adjacent to respective intermediate portions 77*a* and 78*a* of fingers 77 and 78.

An interconnection 80 in the form of a conductive bridge 82 interconnects the distal ends of fingers 72 and 74, and an intermediate portion 73*a* of finger 73. Bridge 82 extends over intermediate finger portions 77*a* and 78*a*, and is also referred to as an intermediate bridge. There are also interconnections 80 between the ends of fingers of set 68 adjacent to ports 63 and 64. Specifically, a first end bridge 84 interconnects finger ends 77*b* and 78*b*, and spans an end 73*b* of finger 73. A second end bridge 86 interconnects finger ends 77*c* and 78*c*, and spans an end 73*c* of finger 73.

As particularly shown in FIG. 3, the fingers and ports of coupler 60 may be mounted on a first primary face 88*a* of a base substrate 88. A ground conductor in the form of a ground plane 90 may be formed on a second primary face 88*b*. The substrate has a thickness D1. Set 67 of fingers may form with ground plane 90 what may be considered a first microstrip transmission line 92, and set 68 may form a second microstrip transmission line 94. The fingers may be separated by a distance D2. In this example, fingers 72, 77, 73 and 78, respectively, have widths of D3, D4, D5 and D6. As shown, finger 73 is the most narrow followed by finger 72, and then finger 77. Finger 78 has the widest width of the fingers. Fingers 77 and 78 may also have the same width. Finger 74, not shown in FIG. 3, has a width corresponding to that of finger 72. The thinner the finger is, generally, the higher the inductance per unit length.

In this second coupler example, fingers 72, 74, 77 and 78 have extensions 72*c*, 74*b*, 77*d* and 78*d* extending from respective outer sides 72*d*, 74*c*, 77*e* and 78*e* facing away from the other fingers. As mentioned, finger 73 is between fingers 77 and 78 and does not have any extensions. The extensions are capacitively coupled to ground and form respective capacitive tabs 100,101, 102 and 103. Tabs 100 and 102 are on the same side of the coupler and separated by a distance D7. Tabs 101 and 103, on the other side of the coupler, are also separated by distance D7. Further, tabs 102 and 103 are each separated from bridge 82 by a distance D8. Tabs 100 and 101 are separated from bridge 82 by a distance D9. Distance D7 is equal to the sum of distances D8 and D9. The sizes of the tabs and the fingers were determined using an electromagnetic simulator and optimizing the operating characteristics of the coupler.

The tabs 102 and 103 on end-bridged fingers 77 and 78 may be placed so that the edges of the tabs are at least as far away from the adjacent ends of the outermost center-bridged fingers 72 and 74, as the minimum spacing between fingers in the coupler. The spacing between fingers is depicted by distance D2 in FIG. 3. This is to say, then, that distance D8 is greater than distance D2. Spacing the edges of the tabs a few times farther than this minimum may reduce parasitics. The tabs 100 and 101 on the center-bridged fingers 72 and 74 may be spaced a distance D7 from the respective tabs 102 and 103 on the end-bridged fingers. Distance D7 may be greater than the thickness D1 of the dielectric substrate 88 so that the dominant coupling is between each tab and a reference conductor, rather than between the adjacent tabs. The spacings may be made smaller than those indicated, but the parasitics will become greater with decreased spacings. The compensation may be increased correspondingly, but this may result in a reduction in the bandwidth.

Coupler 60 also has additional tabs that couple capacitively directly or indirectly to ground, located near or on the ends of the fingers connected to the ports. In particular, a tab extends from each port in a configuration that provides coupling to ground. These tabs include tabs 106, 107, 108 and 109 extending from ports 62, 63, 64 and 65, respectively. Adjacent tabs 106 and 107, and adjacent tabs 108 and 109, are a distance D10 apart. As with distance D7, the distance between adjacent tabs along the fingers of the coupler, distance D10 may be greater than the thickness of the substrate, distance D1, in order to assure that the dominant coupling is between each tab and ground plane 90, rather than between the adjacent tabs.

In summary, then, coupler 60 includes tabs capacitively coupled to ground at the ends of the interdigitated fingers and at intermediate locations along the outer edges of outer fingers 72, 74, 77 and 78. The design depicted in FIGS. 2 and 3 is a 3-dB Lange-style coupler having a bandwidth centered at 38 GHz. The capacitive tabs add lumped capacitance primarily to the even mode, since they do not significantly increase the capacitive coupling between adjacent fingers. The narrow widths of the coupled fingers compensate for the added capacitance with additional inductance for the even mode. The net effect may be an increase in the effective dielectric constant for the even mode, providing improved matching with that of the odd mode.

Figure 4:
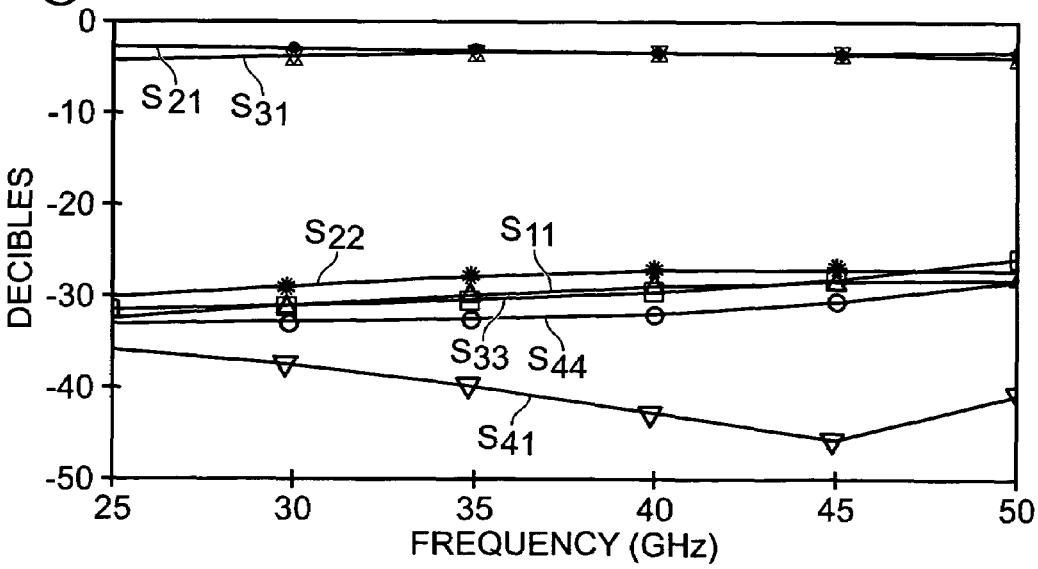
FIG. 4 is a graph showing simulated operating characteristics of the coupler of FIG. 2.

Simulated operating characteristics of coupler 60 over a frequency range of 25 GHz to 50 GHz are illustrated in FIG. 4. The through or direct gain $S_{21}$ and the coupled gain $S_{31}$ are both about −3 dB at 38 GHz, and these values are relatively constant between about 35 GHz and 45 GHz. At 38 GHz, the isolation $S_{41}$, which represents the directivity of the coupler, is below −40 dB, and the return losses ($S_{11}$, $S_{22}$, $S_{33}$ and $S_{44}$) are all below −27 dB.

As stated with regard to coupler 10, many variations may be made in the configuration of coupler 60. For example, the quantities, positions and dimensions of the ports, fingers and tabs may be varied. For example, a plurality of tabs on one or more outer fingers may be used, different numbers of tabs may be provided on different fingers, or some outer fingers may not have a tab. The tabs on the ports may be replaced with or may be in addition to tabs extending from the ends of the fingers near the ports. Further, a three-dimensional configuration of fingers may be used instead of the two-dimensional, planar configuration shown. In a three-dimensional configuration, some or all of the fingers may have a side not adjacent another finger, making them outer fingers that may be suitable to have tabs capacitively coupled to a ground conductor.

Accordingly, while embodiments of couplers have been particularly shown and described with reference to the foregoing disclosure, many variations may be made therein. Other combinations and sub-combinations of features, functions, elements and/or properties may be used. Such variations, whether they are directed to different combinations or directed to the same combinations, whether different, broader, narrower or equal in scope, are also regarded as included within the subject matter of the present disclosure. The foregoing embodiments are illustrative, and no single feature or element is essential to all possible combinations that may be claimed in this or later applications. The claims, accordingly, define inventions disclosed in the foregoing disclosure. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to the telecommunications, computers and other communication-frequency signal processing industries involving the combining or dividing of transmission of signals.

The invention claimed is:

1. A coupler comprising:

at least four ports;

a least first and second planar sets of conductive strips, each set of conductive strips including a plurality of interconnected conductive strips, and each conductive strip of the first set being electromagnetically coupled to at least one conductive strip of the second set, each set of conductive strips being connected between at least two ports, and at least a portion of each conductive strip extending in a common direction with an adjacent conductive strip of the same set;

a ground conductor spaced from the first and second sets of conductive strips; and at least first and second planar conductive tabs capacitively coupled primarily to the ground conductor, the first conductive tab coplanar with and extending directly from the portion of a first conductive strip of the first set, the second conductive tab coplanar with and extending directly from the portion of a second conductive strip of the second set.

2. The coupler of claim 1, of which the first conductive strip is adjacent to a conductive strip of the second set, and the first tab extends from a side of the first conductive strip in a direction opposite from the adjacent conductive strip.

3. The coupler of claim 1, of which the first and second sets of conductive strips are coplanar, and the conductive strips of the first and second sets are interdigitated.

4. The coupler of claim 3, further comprising an interconnection connecting an intermediate position on the portion of at least one conductive strip of the first set of conductive strips with another conductive strip of the first set of conductive strips, and in which the first tab extends from the first conductive strip at a position spaced from the interconnection.

5. The coupler of claim 4, of which the first conductive strip is adjacent to a conductive strip of the second set, and the interconnection is near an end of the first conductive strip and at an intermediate position on the portion of the adjacent conductive strip of the second set, the second tab extending from the adjacent conductive strip at a position spaced from the interconnection.

6. The coupler of claim 5, of which the second tab is spaced closer to the interconnection than the first tab.

7. The coupler of claim 5, of which the first and second tabs extend in generally the same direction.

8. The coupler of claim 7, of which the ground conductor is a ground plane spaced from the plane of the first and second sets of conductive strips by a distance less than between the distance between the first and second tabs.

9. The coupler of claim 5, of which the second tab is spaced further from the interconnection than a spacing between the first and adjacent conductive strips.

10. The coupler of claim 3, of which the first and second tabs extend in generally the same direction, and the ground conductor is a ground plane spaced from the plane of the first and second sets of conductive strips by a distance less than a distance between the first and second tabs.

11. A coupler comprising:

a substrate having first and second faces;

a ground plane on the first face of the substrate;

at least four ports on the second face of the substrate;

first and second coplanar sets of interdigitated conductive strips in alternating configuration on the second face of the substrate, each set of conductive strips including a plurality of conductive strips, each conductive strip of the first set being electromagnetically coupled to at least one conductive strip of the second set, and each set of conductive strips being connected between two ports, with first and second conductive strips being connected between two ports, with first and second conductive strips of the first set having respective ends adjacent to an intermediate portion of respective of respective adjacent third and fourth conductive strips of the second set, the first and second conductive strips and a portion of the third and fourth conductive strips having outer sides not adjacent to another conductive strip;

at least a first interconnection interconnecting the respective ends of the first and second conductive strips, the interconnection extending across the intermediate portions of the third and fourth conductive strips;

at least a second interconnection interconnecting conductive strips of the second set, the first and second interconnection being spaced apart;

a first conductive tab extending along the second face of the substrate capacitively coupled to the ground place, spaced from the first interconnection and integrally connected to and extending from the outer side of each of the first and second conductive strips; and a second conductive tab extending along the second face of the substrate capacitively coupled to the ground plane, spaced from the first interconnection and integrally connected to an extending from the outer side of each of the third and fourth conductive strips.

12. The coupler of claim 11, of which each second tab is spaced closer to the first interconnection than is each adjacent first tab.

13. The coupler of claim 11, of which the ground plane is spaced from the plane of the first and second sets of conductive strips by a distance less than the distance between adjacent first and second tabs.

14. The coupler of claim 11, of which the second tab is spaced further from the first interconnection than a spacing between adjacent conductive strips.

15. A coupler comprising:

at least four ports;

at least first and second sets of conductive strips, each set of conductive strips including a plurality of interconnected conductive strips, each conductive strip of the first set being electromagnetically coupled to at least one conductive strip of the second set, each set of conductive strips being connected between at least two ports, and at least a portion of each conductive strip extending in a common direction with an adjacent conductive strip of the same set;

a ground conductor spaced from the first and second sets of conductive strips; and at least first and second conductive tabs capacitively coupled primarily to the ground conductor, the first conductive tab extending directly from the portion of a first conductive strip of the first set in a first direction, the second conductive tab extending directly from the portion of a second conductive strip of the second set in a second direction generally opposite the first direction.

16. The coupler of claim 15, of which the first conductive strip is adjacent to a conductive strip of the second set, and the first tab extends from a side of the first conductive strip in a direction opposite from the adjacent conductive strip of the second set.

17. The coupler of claim 15, of which the first and second sets of conductive strips are coplanar, and the conductive strips of the first and second sets are interdigitated.

18. The coupler of claim 15, of which the first tab extends directly from an intermediate position on the portion of a conductive strip of the first set, and the second tab extends directly from an intermediate position on the portion of a conductive strip of the second set.

19. The coupler of claim 1, of which the first tab extends directly from an intermediate position on the portion of a conductive strip of the first set, and the second tab extends directly from an intermediate position on the portion of a conductive strip of the second set.

* * * * *